United States Patent [19]

Wang

[11] Patent Number: 4,985,981

[45] Date of Patent: Jan. 22, 1991

[54] WORKPIECE TRANSFERRING MECHANISM OF FORMING PRESS

[75] Inventor: Sheng-Yau Wang, Tainan, Taiwan

[73] Assignee: Chun Zu Machinery Industry Co., Ltd., Tainan, Taiwan

[21] Appl. No.: 551,914

[22] Filed: Jul. 12, 1990

[30] Foreign Application Priority Data

May 16, 1990 [TW] Taiwan ..... 79205270

[51] Int. Cl.[5] ..... B23Q 7/14; B21D 53/24

[52] U.S. Cl. ..... 29/563; 10/76 T; 72/419

[58] Field of Search ..... 29/563, 33 P; 72/361, 72/346, 419; 10/76 R, 76 T, 77, 72 T, 12 T, 166, 162 R, DIG. 2

[56] References Cited

U.S. PATENT DOCUMENTS

| | | | |
|---|---|---|---|
| 2,689,361 | 9/1954 | Schaeffer et al. | 10/72 T |
| 3,022,526 | 2/1962 | Davis et al. | 10/76 T |
| 3,259,929 | 7/1966 | Van de Meerendeek | 72/419 |
| 3,425,073 | 2/1969 | McMurray | 10/76 T |

FOREIGN PATENT DOCUMENTS

| | | | |
|---|---|---|---|
| 508433 | 1/1952 | Belgium | 10/76 T |
| 710740 | 1/1980 | U.S.S.R. | 29/563 |

*Primary Examiner*—William Briggs
*Attorney, Agent, or Firm*—Brooks & Kushman

[57] ABSTRACT

A swinging mechanism for workpiece holding members of a nut former includes a drive rod to swing a swinging member which is connected to a plurality of seats to support the workpiece holding members. The swinging member is connected to the machine body with two connecting members which are pivoted to the machine body with two first pivot shafts. An elongated crank support member to support cranks which actuate the workpiece holding members is mounted on a pair of connecting members which swing about two second pivot shafts respectively adjacent to the first pivot shafts. Two eccentric members are respectively mounted on one of the first pivot shafts and one of the second pivot shafts, and a third connecting member is mounted on the eccentric members. The movement of the swinging member is transmitted to the crank support member through the first, second and third connecting members.

1 Claim, 11 Drawing Sheets

WORKPIECE TRANSFERRING MECHANISM OF FORMING PRESS

BACKGROUND OF THE INVENTION

This invention relates to a workpiece transferring mechanism of a forming press which includes a plurality of workpiece holding members each reciprocating between two dies to transfer a workpiece from one die to the other die, crank mechanisms to actuate said workpiece holding members to move between a clamping position and a releasing position, and a swinging mechanism connected to the workpiece holding members and the crank mechanisms so as to swing the workpiece holding members and to swing the crank mechanisms synchronously with the workpiece holding members. Particularly, the invention relates to a swinging mechanism of the forming press.

A known press for forming nuts is shown in FIGS. 1 to 4. The press comprises five workpiece holding members B (only one workpiece holding member B is shown in the drawings in detail; the remaining is omitted) whose top ends are respectively connected to crank mechanisms with bolts B1. Each crank mechanism has a first crank A4, a second crank A2 and a cam A1 and actuates each workpiece holding member B to alternately perform clamping and releasing operations. The second cranks A2 are aligned and are turnable about a common horizontal axis A21. The input end of the cranks A2 are actuated by the cam A1 and the output ends thereof are provided with bolts A22 and arranged above the input ends A41 of the cranks A4 to depress the same. A pneumatically operated plunger E2 of a pneumatic cylinder El which is mounted on a stationary part E of the machine pushes upward the input end of each crank A4 so that the input end of each crank A4 is movably clamped between the plunger E2 and the output end of each crank A2 and is turnable about a vertical axis while being moved upward and downward by the crank A2. The output end A42 of each crank A4 is connected to the top end of each workpiece holding member B. The upward and downward movement of the cranks A4 actuates the clamp portions B8 of the workpiece holding members to alternately clamp and release the workpieces F.

The cranks A4 are aligned and mounted pivotally on a common reciprocating elongated crank support member C3 which swings the cranks A4 simultaneously. An elongated swinging member C2 is provided longitudinally below the crank support member C3. Two levers C23 are mounted in the two end portions of the swinging member C2. Pivot rods C22 are used to connect one ends of the levers C23 to the end portions of the swinging member C2. The other ends of the levers C23 are pivoted to a stationary machine frame with pivot members E3. The crank support member C3 is mounted on the levers C23 with mounting rods C21. The supports E3 are arranged in alignment with the input ends of the cranks A4. The swinging member C2, the levers C23 and the machine frame form a parallelogram linkage system in which the swinging member C2 is reciprocated by the reciprocating drive rod C1. When the swinging member C2 is moved by the drive rod C1, the levers C23 reciprocate accordingly so that the crank support member C3 moves synchronously with the swinging member C2. As a result, the workpiece holding members B are moved between adjacent dies D and the cranks A4 move synchronously with the workpiece holding members B to actuate the same to perform clamping and releasing operations. Each workpiece holding member B has a gear B3 engaging a slightly curved rack member B2 so that the workpiece holding member B is moved along a proper path.

FIG. 5 shows schematically the parallelogram linkage system comprising one of the cranks A4, one of the levers C23, the crank support member C3. From the figure, it can be noted that the distance 'b', i.e. the distance that the swinging member needs to travel is longer than that the crank support member C3 needs to travel. Since the levers C23 are long in order to optimize the applied force required to swing the cranks A4 and the workpiece holding members b, the drive rod C1 has to reciprocate with a long amplitude, thereby reducing the speed of the swinging member. On the other hand, the two end portions of the swinging member must be of large volume to receive the long levers C23, thereby requiring considerable energy consumption to operate the swinging mechanism.

SUMMARY OF THE INVENTION

An object of the invention is to provide a swinging mechanism for the forming press of the above-mentioned type, including a swinging member with a reduced volume.

Another object of the invention is to provide a swinging mechanism for the forming press of the above-described type, which swinging mechanism has a simplified construction in which the crank support member is not mounted directly on the levers which interconnect the swinging member and the machine frame.

According to the present invention, a swinging mechanism for a forming press includes an elongated swinging member extending longitudinally below the crank support member and having two ends respectively on two sides of the workpiece holding members, a pair of first vertical pivot shafts provided fixedly on the machine frame on two sides of the pneumatically operated plungers, a pair of first connecting members each connected to one of the first vertical pivot shafts and one of the two ends of the swinging member, a reciprocating drive rod connected to the swinging member, a pair of second vertical pivot shafts respectively disposed adjacent to and aligned with the first vertical pivot shafts, a pair of second connecting members each connected to both one of the second vertical pivot shafts and the elongated crank support member, a first eccentric member mounted on one of the first vertical pivot shafts above the first connecting member, a second eccentric member mounted on one of the second vertical pivot shafts above the second connecting member near said one first vertical pivot shaft, a third connecting member mounted on the first and second eccentric members, whereby the movement of the swinging member is transmitted to the elongated crank support member through the first, second and third connecting members and the first and second eccentric members.

The present exemplary preferred embodiment will be described in detail with reference to the accompanying drawings, in which:

DETAILED DESCRIPTION OF THE PREFERRED EMBODIMENT

Figure 1:
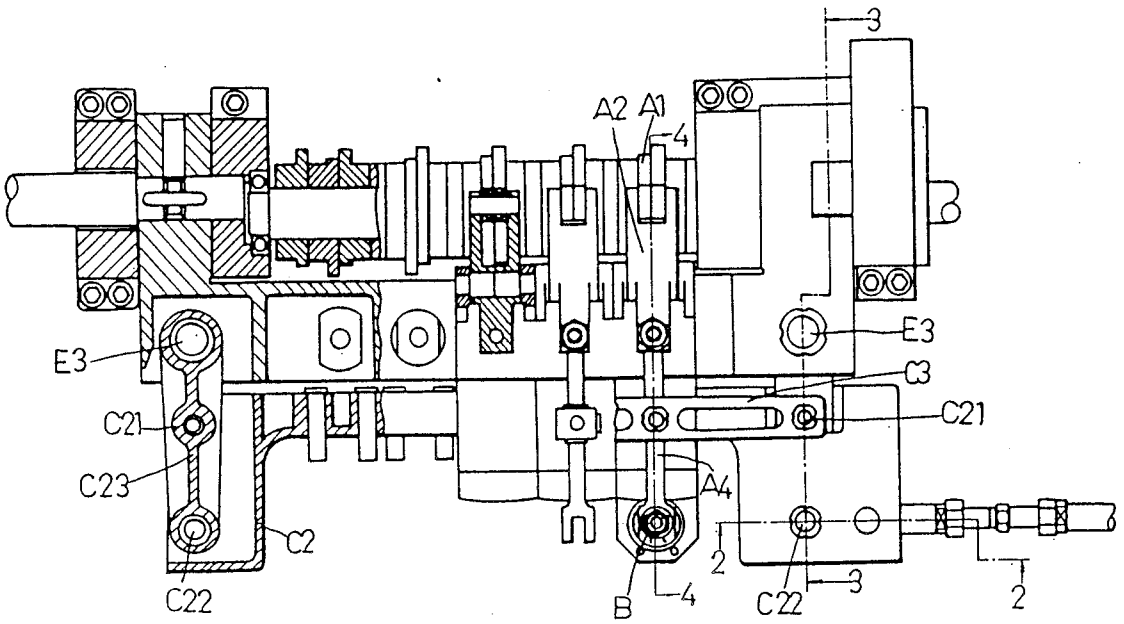
FIG.1 PRIOR ART
FIG. 1 a partially sectioned top plan view of a known nut former.
Figure 2:
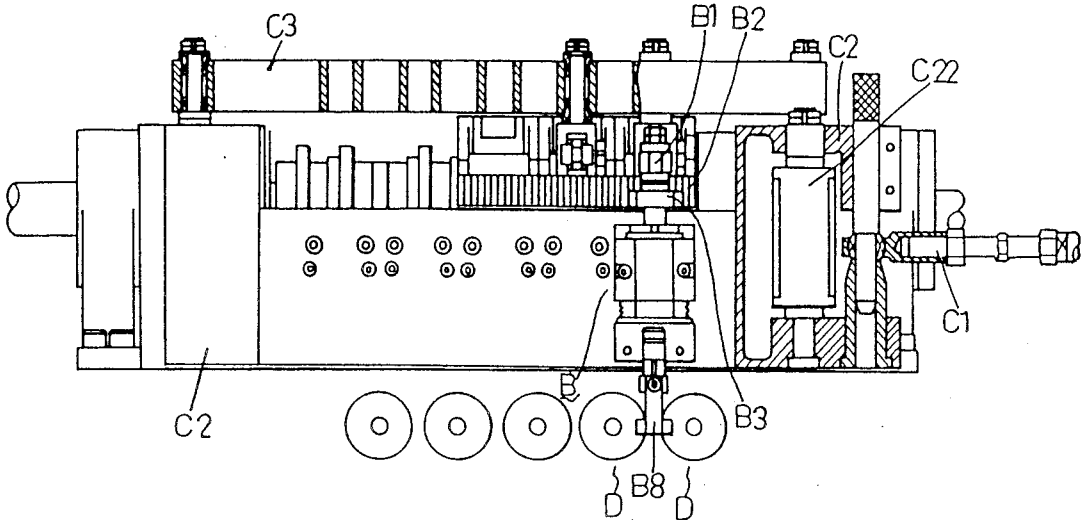
FIG. 2 PRIOR ART
FIG. 2 is a partially sectioned front elevation view of the nut former of FIG. 1.
Figure 3:
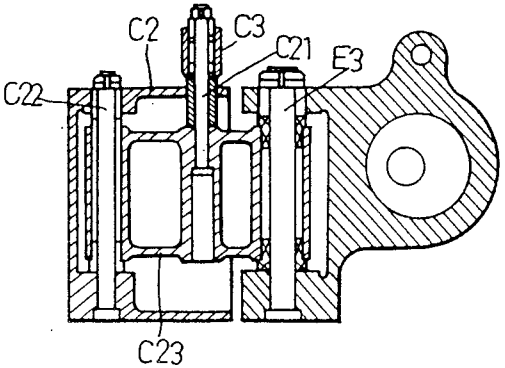
FIG. 3 PRIOR ART
FIG. 3 is a sectional view taken along line 3—3 of FIG. 1.
Figure 4:
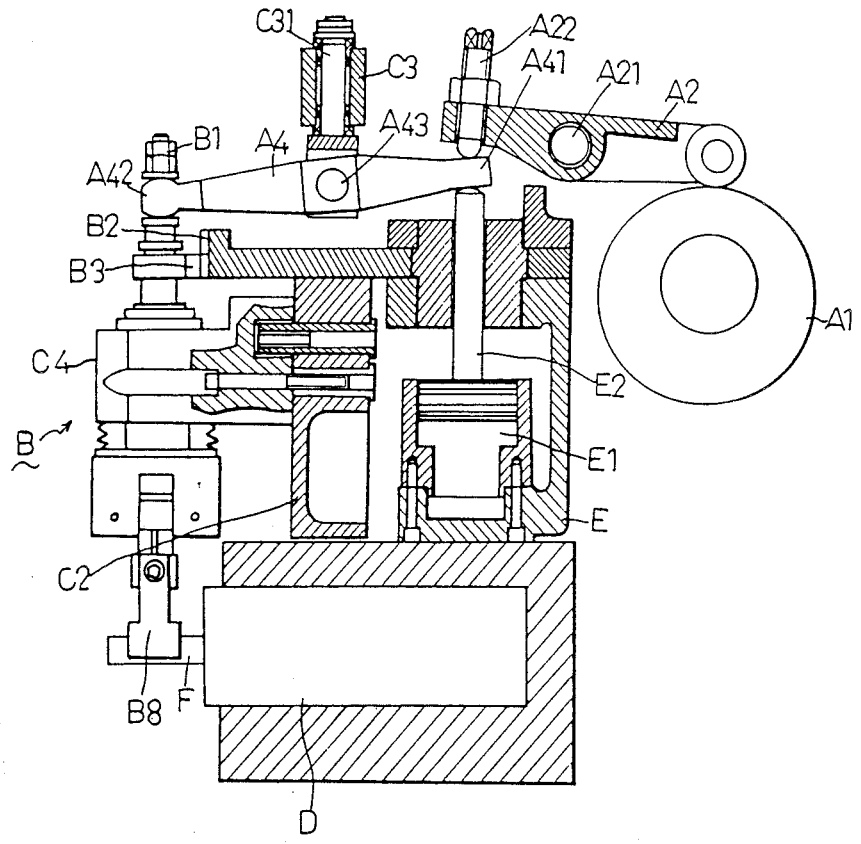
FIG. 4 PRIOR ART
FIG. 4 is a sectional view taken along line 4—4 of FIG. 1.
Figure 5:
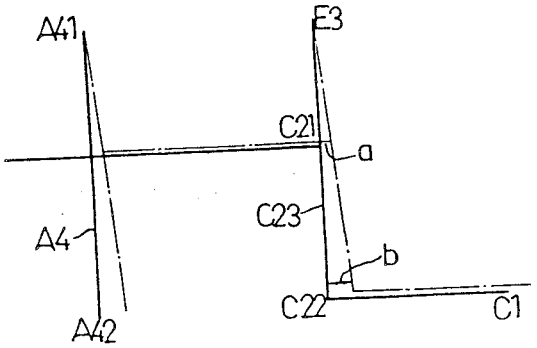
FIG. 5 PRIOR ART
FIG. 5 is a diagram showing the parallelogram linkage system formed by the swinging mechanism of FIG. 1.

The swinging mechanism according to the present invention is shown in FIGS. 6 to 10. Five aligned cranks A4 are mounted on an elongated crank support member 2. The swinging mechanism includes a swinging member 1 is disposed longitudinally below the crank support member 2 and connected to seats 13 each supporting a workpiece holding member (not shown). A reciprocating drive rod 11 is connected to a vertical connecting rod 111 which is attached to one end of the swinging member. The two end portions of the swinging member 1 are connected by means of two connecting members 3 to a machine frame 6 of a nut former of the type described hereinbefore. Two pivot shafts 62 are provided on the machine frame 6 in alignment with and on two sides of the pneumatically operated plungers E2 (shown in FIG. 3) which acts on the input ends of the cranks A4 as described hereinbefore.

As shown in FIG. 6, 8, 9 and 12, one end of each connecting member 3 is connected to the swinging member 1 with a pivot rod member 35 which is inserted in a sleeve portion 36 of the connecting rod member 3 and secured to one end of the swinging member 1. Each connecting rod member 3 further has a sleeve portion 31 sleeved around one of the pivot shafts 62, thereby being pivoted to the machine frame 6. A transmitting sleeve member 32 is sleeved around one of the pivot shaft 62 above the sleeve portion 31 and is engaged with the sleeve portion 31 by the engagement of a protrusion 34 into a recess of the sleeve portion 31. The transmitting sleeve member 32 has an eccentric neck portion 33. The other pivot shaft 62 shown in FIG. 12 has a sleeve member 32' thereon above the sleeve portion 31 of the connecting member 3. The sleeve member 32' has no eccentric neck portion 33.

Referring to FIGS. 6, 8, 10 and 13, the machine frame 6 further has two second pivot shafts 63 on two sides of the pivot shafts 62. Two second connecting members 4 is connected to the pivot shafts 63. Sleeve portions 41 at one ends of the connecting members 4 are sleeved around the pivot shafts 63. Mounting rods 22 are attached to the other ends of the connecting members 4 to mount a crank support member 2 thereon. Cranks A4 are pivotally mounted on the crank support member 2. The output ends of the cranks A4 are connected to the top ends of the workpiece holding members with bolts 12. The input ends A41 of cranks A4 are disposed below the bolts 61 which are attached to the output ends of cranks A2. A transmitting sleeve 42 is mounted on one of the pivot shafts 63 which is adjacent to the pivot shaft 62 which incorporates the eccentric neck portion 33. An eccentric neck portion 3 is formed on the transmitting sleeve 42. A sleeve member 42' which has no eccentric neck portion 43 is mounted on the other pivot shaft 63 shown in FIG. 13. A third connecting member 5 is mounted on the eccentric neck portions 32 and 42, thereby interconnecting the connecting members 3 and 4.

Figure 11:
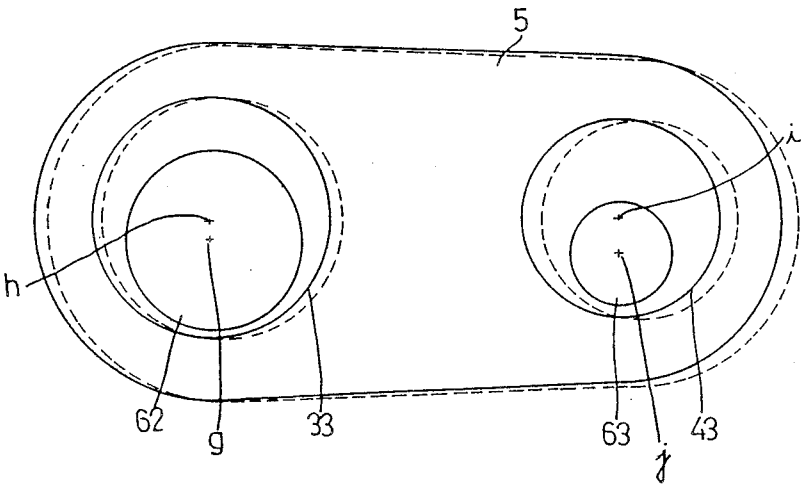
FIG. 11 is a plan view of the third connecting member of the swinging mechanism of FIG. 6.
Figure 13:
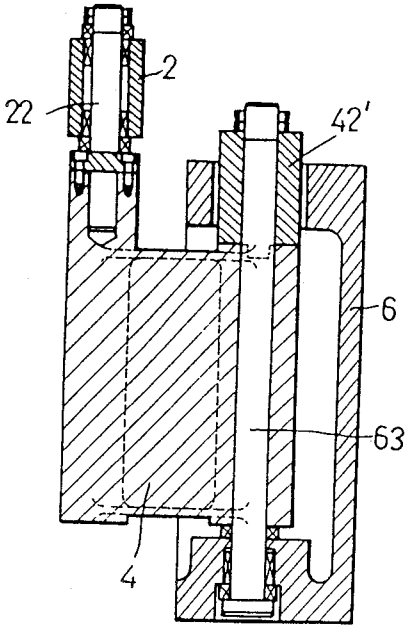
FIG. 13 is a sectional view taken along line 13—13 of FIG. 6.
Figure 12:
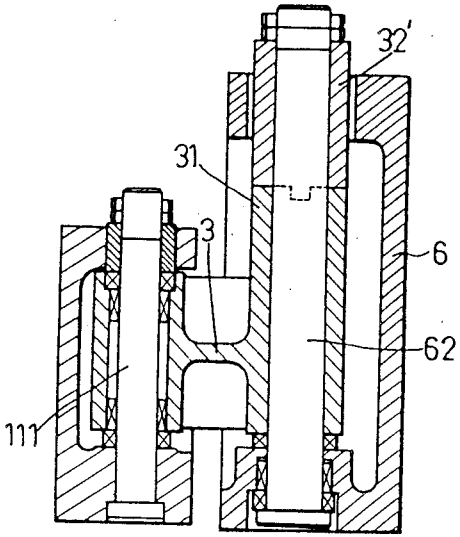
FIG. 12 is a sectional view taken along line 12—12 of FIG. 6.

In operation, the drive rod 11 reciprocates the swinging member 1. The swinging member 1, in turn, reciprocates the seats 13 of the workpiece holding members. The movement of the swinging member 1 is also transmitted to the crank support member 2 through the first connecting members 3, the eccentric neck portions 3, 43 of the transmitting sleeves 32 and 42, the third connecting member 5 and the second connecting members 4. The connecting member 5, the eccentric neck portions 33 and 43 and the pivot shafts 62, 63 forms a four-bar linkage mechanism as shown in FIG. 11, wherein 'g' and 'j' respectively represent the centers of the pivot shaft 62, 'h' and 'i' respectively represent the centers of the eccentric neck portions 33 and 43, the lines 'gh' and 'ji' (the amount of the deviation from the centers 'g', 'j') represent a pair of levers and the line 'hi' represents the connecting member 5.

Figure 6:
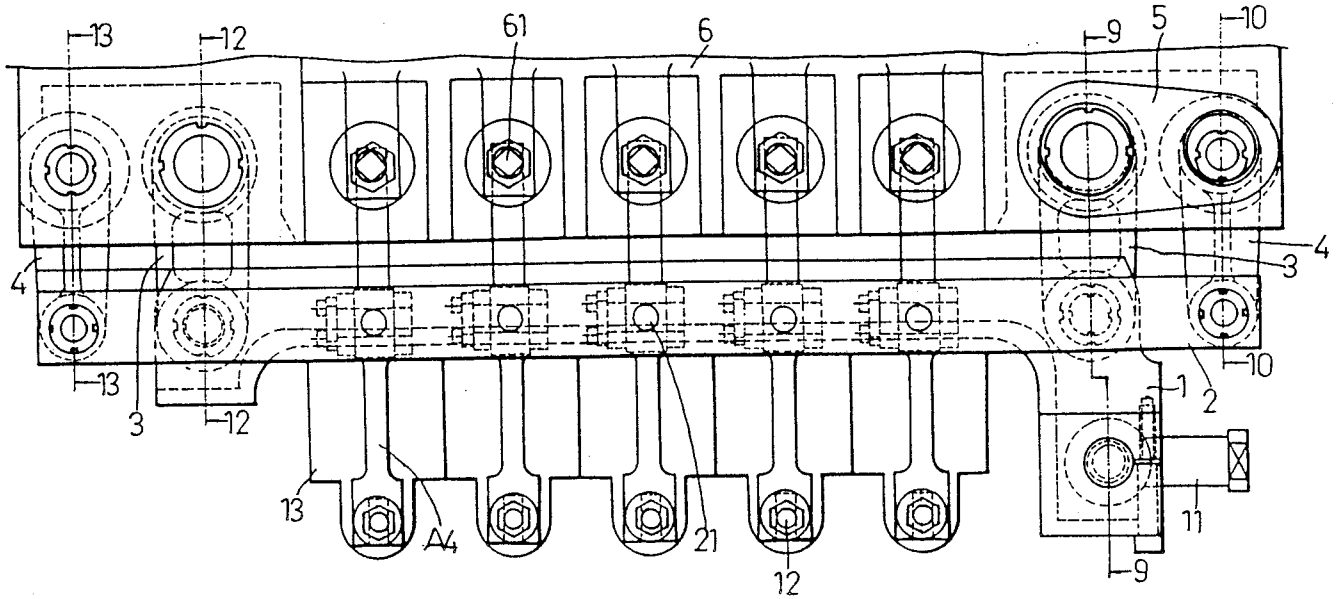
FIG. 6, 7 and 8 are top plan views of a swinging mechanism embodying the present invention.
Figure 7:
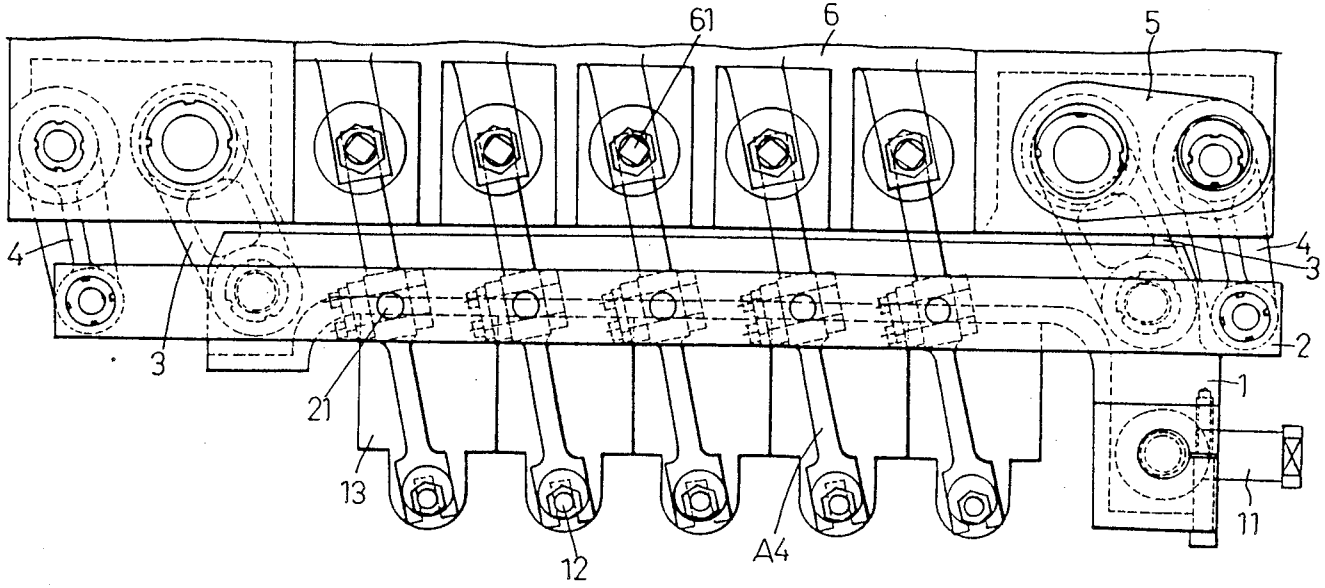
Figure 8:
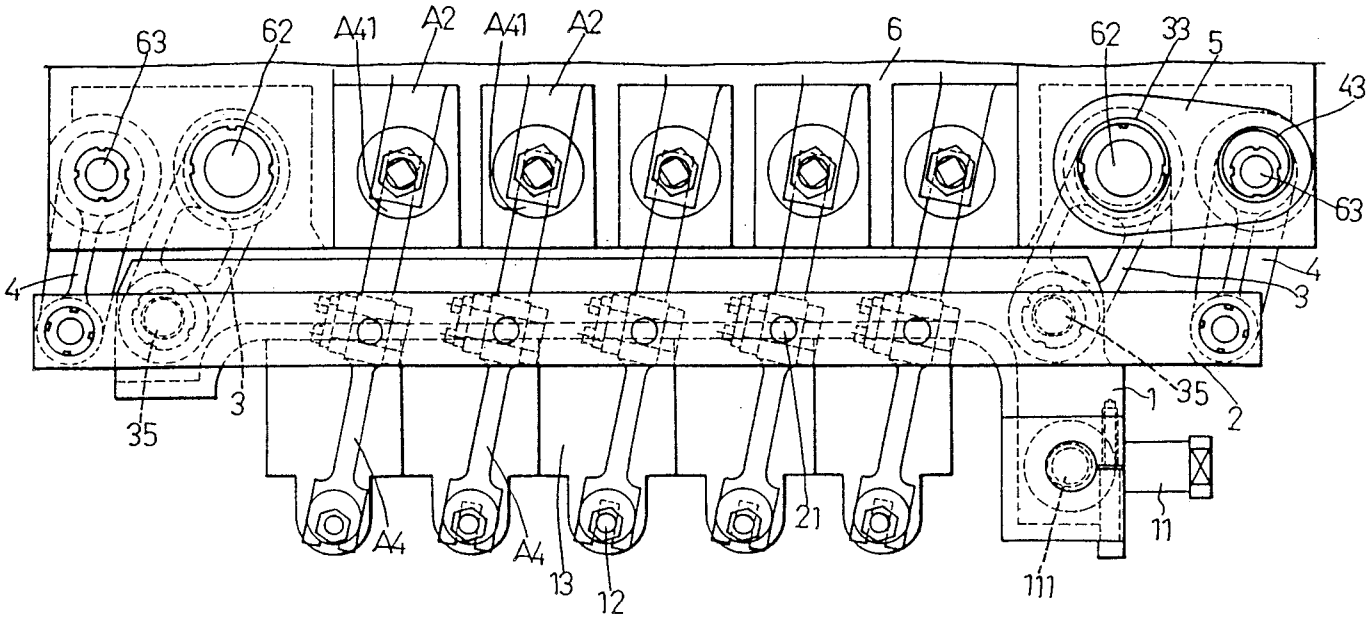
Figure 10:
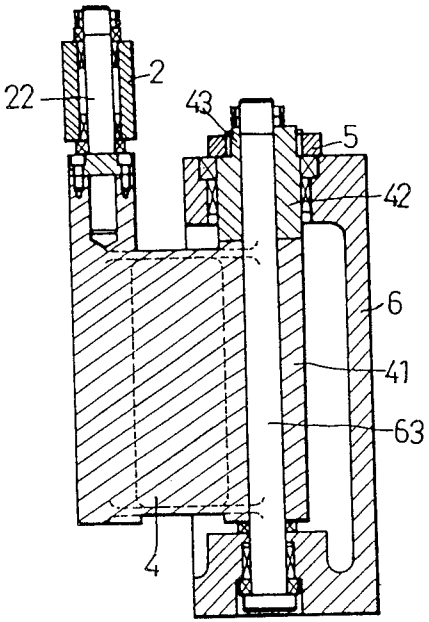
FIG. 10 is a sectional view taken along line 10—10 of FIG. 7.
Figure 9:
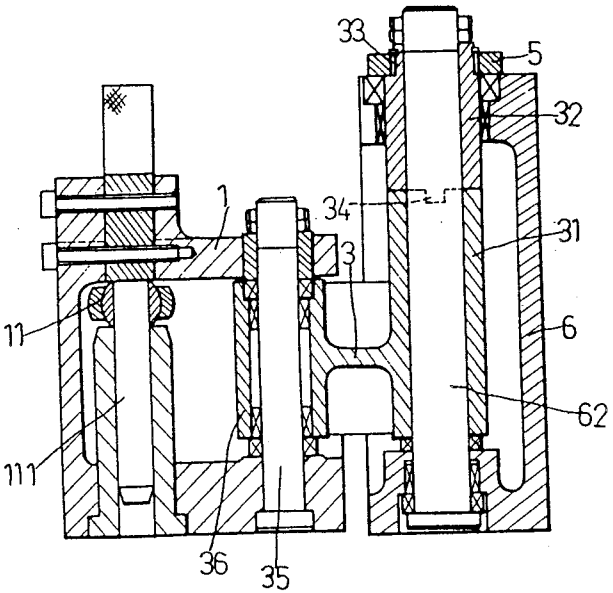
FIG. 9 is a sectional view taken along line 9—9 of FIG. 6.

From FIGS. 6, 7 and 8, it can be appreciated that the end of each crank A4 bearing the bolt 12 reciprocates with a greater amplitude than the intermediate portion of the crank A4 pivoted at 21, and thus, the amplitude of the crank support member 2 which moves the crank A4 is smaller than that of the swinging member 1 which reciprocates the seats 13. Therefore, the amplitude of the connecting member 3 should be greater than that of the connecting member 4. To this end, the magnitude of 'gh' is arranged to be greater than the magnitude of 'ji'. By choosing an appropriate ratio of 'gh' and 'ji', the connecting members 3 and 4 can be arranged to turn at proper angles respectively.

The connecting members 3 are shorter than the levers C23 because the crank support member 2 is not mounted on the connecting members 3, unlike the crank support member C3 which is mounted on the levers C23. As a result, the size of the swinging member is reduced and the construction of the swinging member is simplified.

With the invention thus explained, it is apparent that modifications and variations can be made without departing from the scope of the invention. It is therefore intended that the invention be limited only as indicated in the appended claims.

I claim:

1. A workpiece transferring mechanism for a former which has a machine frame and a plurality of dies, said workpiece transferring mechanism including a plurality of aligned workpiece holding members each moving between a clamping position and a releasing position while moving between two of said dies to transfer a workpiece, an elongated crank support member disposed movably above said aligned workpiece holding members, a plurality of aligned first cranks mounted pivotally on said crank support member, each of said first cranks having an output end which reciprocates upward and downward and is connected to each of said workpiece holding members and an input end opposite to said output end, a plurality of aligned second cranks each having an output end disposed above said input end of each of said first cranks and an opposite input end, a plurality of pneumatically operated plungers each disposed below and pushing said input end of each of said first cranks upward against said output end of each of said second cranks, thereby clamping said input end of each of said first cranks and permitting said input end of each of said first cranks to turn upward and downward as well as to rotate, a plurality of cams each cooperatively associated with said input end of each of said second cranks, said cams actuating said second cranks which in turn actuate said first cranks, and a swinging mechanism to reciprocate said workpiece holding members between two of said dies as well as to reciprocate said crank support member synchronously with said workpiece holding members, said swinging mechanism including an elongated swinging member extending longitudinally below said crank support member and supporting all of said workpiece holding members, said swinging member having two ends respectively extending at two sides of said workpiece holding members, a pair of first vertical pivot shafts provided fixedly on said machine frame on two sides said pneumatically operated plungers, a pair of first connecting members each connected to one of said first vertical pivot shafts and one of said two ends of said swinging member, a reciprocating drive rod connected to said swinging member, and improvements which comprise a pair of second vertical pivot shafts respectively disposed adjacent and aligned with said first vertical pivot shafts, a pair of second connecting members each connected to one of said second vertical pivot shafts and said elongated crank support member, a first eccentric member mounted on one of said first vertical pivot shafts above said first connecting member, a second eccentric member mounted on one of said second vertical pivot shafts above said second connecting member near said one of said first vertical pivot shafts, a third connecting member mounted on said first and second eccentric members, whereby the movement of the swinging member is transmitted to the elongated crank support member through said first, second and third connecting members and said first and second eccentric members.

* * * * *

UNITED STATES PATENT AND TRADEMARK OFFICE

CERTIFICATE OF CORRECTION

PATENT NO. : 4,985,981

DATED : January 22, 1991

INVENTOR(S) : Sheng-Yau Wang

It is certified that error appears in the above-identified patent and that said Letters Patent is hereby corrected as shown below:

Column 1, Line 53
"ends" should be --end--.

Column 3, Line 61
"ends" should be --end--.

Column 4, Line 5 "3"
should be --43--.

Column 4, Line 17 "3"
(second occurrence) should be --33--.

Signed and Sealed this

Seventeenth Day of December, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,985,981

DATED : January 22, 1991

INVENTOR(S) : Sheng-Yau Wang

It is certified that error appears in the above-identified patent and that said Letters Patent is hereby corrected as shown below:

On the title page, item [73], delete Assignee's address of "Tainan, Taiwan" and insert --Kaohsiung, Taiwan--

Signed and Sealed this

Seventeenth Day of November, 1992

*Attest:*

DOUGLAS B. COMER

*Attesting Officer*

*Acting Commissioner of Patents and Trademarks*